US007801732B2

(12) United States Patent
Park et al.

(10) Patent No.: US 7,801,732 B2
(45) Date of Patent: Sep. 21, 2010

(54) AUDIO CODEC SYSTEM AND AUDIO SIGNAL ENCODING METHOD USING THE SAME

(75) Inventors: Yong Chul Park, Seoul (KR); Jung Min Song, Seoul (KR); Jae Myuck Lee, Seoul (KR); Jun Yup Lee, Yongin-si (KR)

(73) Assignee: LG Electronics, Inc., Seoul (KR)

( * ) Notice: Subject to any disclaimer, the term of this patent is extended or adjusted under 35 U.S.C. 154(b) by 1180 days.

(21) Appl. No.: 11/065,950

(22) Filed: Feb. 24, 2005

(65) Prior Publication Data

US 2005/0192796 A1 Sep. 1, 2005

(30) Foreign Application Priority Data

Feb. 26, 2004 (KR) ..... 10-2004-0013130

(51) Int. Cl.
*G10L 19/00* (2006.01)

(52) U.S. Cl. ..... 704/500; 704/219; 704/205; 704/221; 704/230; 704/229; 341/50; 700/94; 370/394

(58) Field of Classification Search ..... 704/219, 704/205, 221, 230, 500, 229; 700/94; 370/394; 341/50; 707/104.1; 390/394
See application file for complete search history.

(56) References Cited

U.S. PATENT DOCUMENTS 3,631,520 A * 12/1971 Atal ..... 704/219
4,748,620 A * 5/1988 Adelmann et al. ..... 370/394
5,182,773 A * 1/1993 Bahl et al. ..... 704/222
5,414,796 A * 5/1995 Jacobs et al. ..... 704/221
6,094,636 A * 7/2000 Kim ..... 704/500
6,108,626 A * 8/2000 Cellario et al. ..... 704/230
6,122,618 A * 9/2000 Park ..... 704/500
6,148,288 A * 11/2000 Park ..... 704/500
6,256,608 B1 * 7/2001 Malvar ..... 704/230
6,349,284 B1 * 2/2002 Park et al. ..... 704/500
6,438,525 B1 * 8/2002 Park ..... 704/500
6,456,964 B2 * 9/2002 Manjunath et al. ..... 704/205

(Continued)

FOREIGN PATENT DOCUMENTS

EP 0 905 918 A2 3/1999

(Continued)

OTHER PUBLICATIONS

Moriya et al.; A Design of Lossy and Lossless Scalable Audio Coding; Acoustics, Speech, and Signal Processing, 2000. ICASSP 2000. Proceedings 2000 International Conference on; vol. 2, Jun. 5-9, 2000, pp. 889-892 vol. 2.*

(Continued)

*Primary Examiner*—James S Wozniak
*Assistant Examiner*—Michael C Colucci
(74) *Attorney, Agent, or Firm*—Lee, Hong, Degerman, Kang & Waimey

(57) ABSTRACT

An audio codec system and an encoding method using the same are provided. According to the method, encoding and decoding processes are repeatedly performed so as to determine optimized coding parameters when analog audio signals being inputted are encoded. The processes of encoding and decoding inputted analog audio signals using initial coding parameters, and computing new parameters using a differential computed during the encoding process are repeatedly performed.

19 Claims, 3 Drawing Sheets

U.S. PATENT DOCUMENTS

| | | | | |
|---|---|---|---|---|
| 6,549,147 | B1 * | 4/2003 | Moriya et al. | 341/50 |
| 7,240,001 | B2 * | 7/2007 | Chen et al. | 704/230 |
| 7,277,849 | B2 * | 10/2007 | Streich et al. | 704/229 |
| 2002/0002412 | A1 * | 1/2002 | Gunji et al. | 700/94 |
| 2003/0004710 | A1 * | 1/2003 | Gao | 704/219 |
| 2003/0212551 | A1 * | 11/2003 | Rose et al. | 704/230 |
| 2004/0117403 | A1 * | 6/2004 | Horn et al. | 707/104.1 |
| 2008/0195383 | A1 * | 8/2008 | Shlomot et al. | 704/205 |

FOREIGN PATENT DOCUMENTS

| | | |
|---|---|---|
| JP | 08-213915 | 8/1996 |
| WO | WO 0207447 | 1/2002 |
| WO | 2004/073224 | 8/2004 |
| WO | 2006/002550 | 1/2006 |

OTHER PUBLICATIONS

L. Hanzo, "Voice Compression and Communications: Principles and Applications for Fixed and Wireless Channels" Dec. 31, 1999.

Hanzo L. Somerville F C A, Woodard J P: "Voice Compression and communication-Printicples and applications for fixed and wireless channels".
2001, Institute of Electrical and Electronic Engineering Inc., New York, XP002331006; p. 43-50.

* cited by examiner

AUDIO CODEC SYSTEM AND AUDIO SIGNAL ENCODING METHOD USING THE SAME

CROSS-REFERENCE TO RELATED APPLICATIONS

Pursuant to 35 U.S.C. §119(a), this application claims the benefit of earlier filing date and right of priority to Korean Application No. 13130/2004, filed on Feb. 26, 2004, the contents of which are incorporated by reference herein in their entirety.

BACKGROUND OF THE INVENTION

1. Field of the Invention

The present invention relates to a codec system for audio signals, and more particularly, to an audio signal encoding apparatus and a method using the same for optimizing coding parameters through repeated encoding and decoding of audio signals.

2. Description of the Related Art

Real audio signals such as voice signals all have analog characteristics. Analog audio signals should be converted into information of digital signals so that processes such as recording, transmission, and playing may be performed for the audio signals using a computer.

A digital audio encoder-decoder, namely, an audio codec is a device for converting inputted analog audio signals into digital signals. The analog signals are converted into the digital signals by the encoder of the codec. On the contrary, the digital signals are converted into the analog signals by the decoder of the codec so that a user may hear the signals.

Generally, the audio codec receives the analog audio signals, encodes and decodes the received signals, and outputs the same (or very similar) audible signals as the received signals.

At this point, whether to maximize quality of decoded signals or to minimize an amount of information required for encoding the signals should be determined when the analog audio signals are converted into digital audio signals. Further, consideration should be given to balance between the above-described two contradictory goals in designing an audio codec system.

Specifically, quality (substantiality), data rate, complexity, delay time are considered for design requirements of the audio codec system. Design is made by applying different balance between these factors depending on practical application fields and necessities.

Here, the quality (substantiality) is a factor that measures how much an output of the codec is alike an original analog audio signal from an auditive point of view. Quality requirements can be changed depending on application fields. High data rate, high complexity, and long delay time are required to obtain high quality.

The data rate is a factor related to bandwidth capacity and a space for data storage of an entire system. High data rate means that high cost is consumed in storing and transmitting the digital audio signals.

Further, the complexity that performs encoding/decoding processes is a factor related to hardware/software costs of the encoder and the decoder. The complexity of the codec system is determined by complexity requirements depending on application fields.

In a related art, pulse code modulation (PCM) type audio codec has been used for the most simple and general audio codec. The PCM-type encoder performs sampling of analog signals by a predetermined period of time and quantizes sizes of signals to express the signals using predetermined codes.

At this point, loss of information included in original analog signals can be prevented by sufficiently raising a sampling rate during a sampling process but information included in the original signals is essentially lost more or less during the quantization process.

Further, the quantized codes are decoded during a decoding process and signal sequences sampled with respect to discrete time are interpolated so that analog output signals are computed.

That is, whether how much the output signals become similar to the originally received signals is determined depending on how much information is maintained without loss during the quantization process.

Recently, an audio codec system for storing signals in a smaller storage space while obtaining better quality is under development. However, even in that case, the complexity is increased.

General audio encoding applications of a related art assume a real-time or a quasi-real-time audio encoding. Accordingly, the complexity of the encoder is increased and thus the complexity of the decoder is also increased.

As a result, according to the related art, the storage space is increased when the audio signals are stored and transmitted so as to obtain optimized quality and transmission efficiency is lowered in case the storage space is limited.

SUMMARY OF THE INVENTION

Accordingly, the present invention is directed to an audio codec system and an audio signal encoding method using the same that substantially obviate one or more problems due to limitations and disadvantages of the related art.

An object of the present invention is to provide an audio codec system and an audio signal encoding method using the same capable of reducing a storage space when storing and transmitting audio signals and improving transmission efficiency by repeatedly performing an encoding and a decoding to optimize coding parameters that realizes optimized quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an audio codec system, which includes: an encoder for encoding analog audio signals being inputted using predetermined coding parameters; a decoder for decoding the audio signals encoded by the encoder using the same coding parameters as the parameters of the encoder and outputting the decoded signals to the encoder; a differential computation block for computing a differential that corresponds to a difference between an actually inputted signal and an estimated signal through the encoding and the decoding; and a coding parameter computation block for computing new coding parameters using the differential computed by the differential computation block and a quantization critical value.

In another aspect of the present invention, there is provided a method for encoding audio signals, which includes the steps of: encoding analog audio signals being inputted using initial coding parameters; decoding the encoded audio signals using the initial coding parameters and re-encoding the decoded signals; computing a differential through the encoding and the decoding steps and computing new coding parameters using the computed differential; repeatedly performing the encoding and the decoding steps using the new computed coding parameters; and if optimized coding parameters are obtained through the repeated encoding and decoding steps, encoding the signals using the obtained optimized coding parameters.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

The present invention relates to an audio codec system and an audio signal encoding method using the same capable of optimizing only coding parameters without increasing complexity of a decoder provided within a codec, namely, without changing a coding method itself in case there exist no real-time encoding requirements and there exist only real-time decoding requirements. For that purpose, the present invention adopts a process for repeatedly performing an encoding and a decoding to optimize coding (encoding) parameters that optimizes quality.

Figure 1:
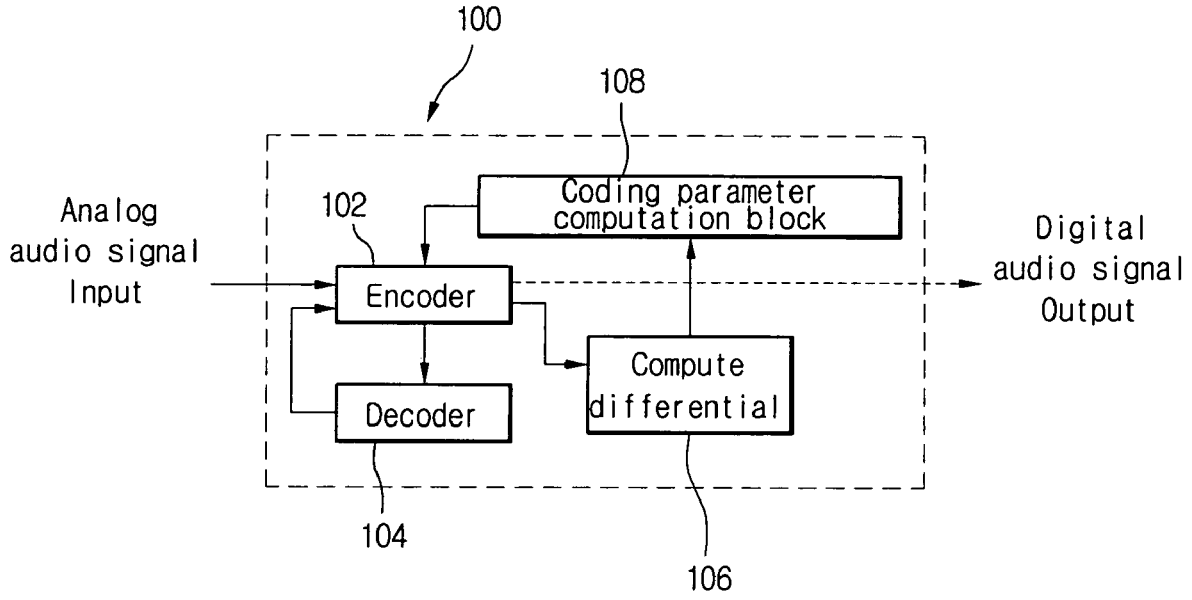
FIG. 1 is a block diagram of an audio codec system according to an embodiment of the present invention.

FIG. 1 is a block diagram of an audio codec system according to an embodiment of the present invention.

First, referring to FIG. 1, the audio codec system 100 according to the embodiment of the present invention includes: an encoder 102 for encoding analog audio signals being inputted using initial coding parameters or new coding parameters; decoder 104 for decoding the audio signals encoded by the encoder using the same coding parameters as the parameters of the encoder and outputting the decoded signals to the encoder 102; a differential computation block 106 for computing a differential obtained through the encoding and the decoding; and a coding parameter computation block 108 for computing new coding parameters using the computed differential.

An encoding method by the audio codec system according to the embodiment of the present invention will be described below with reference to FIG. 1.

First, if analog audio signals are initially inputted, the encoder 102 encodes the analog signals using initial coding parameters set in advance.

The decoder 104 decodes the encoded audio signals using the initial coding parameters. Here, the encoder and the decoder 102 and 104 use the same coding parameters.

Further, the signals decoded by the decoder 104 are inputted again to the encoder 102, so that the encoder 102 re-encodes the inputted decoded signals.

The differential computation block 106 computes a differential from results of the re-encoding by the encoder 102.

Therefore, the differential means a difference between an estimated value and an actual value of an audio signal in estimating a sample value of a current audio signal from a sample of a predetermined number of past audio signals.

At this point, the actual value means a value of a signal to be encoded originally at a predetermined point and the estimated value means an estimation of the signal at the predetermined point.

Further, the coding parameter computation block 108 computes new parameters using the differential computed by the differential computation block 106. Specifically, the coding parameter computation block 108 computes the new parameters through quantization of the differential.

After that, the above-described processes, i.e., the processes of transferring the signals decoded by the decoder 104 to the encoder 102 and re-encoding, at the encoder 102, the signals, and decoding, at the decoder 104, the encoded signals using new coding parameters computed by the coding parameter computation block 108, and transferring the decoded signals to the encoder 102, are repeatedly performed.

At this point, the new coding parameters for the encoding and the decoding processes are repeatedly computed and applied. If optimized coding parameters are computed, the audio signals are encoded using the optimized coding parameters.

That is, the encoding method by the audio codec system according to the present invention encodes/decodes analog audio signals being inputted using the initial coding parameters, repeatedly encodes/decodes using the new coding parameters obtained afterwards to compute optimized coding parameters, and finally encodes the analog audio signals using the optimized coding parameters.

Here, the audio signals inputted as the encoding and the decoding are repeatedly performed in the codec system of the present invention are signals that need not to be encoded in real time or signals that are encoded in advance for later use.

The repeated encoding/decoding processes and the process of optimizing coding parameters will be described in more detail below.

First, the repeated encoding means estimating a current sample value from a predetermined number of past samples with respect to the audio signals being inputted and quantizing a difference between the estimated value and the actual value. At this point, the estimating of the current sample value is performed by the following equation.

$$e(n) = rs(n-1) + \sum_{i=1}^{M} w(i) * rd(n-i)$$

where, e(n) is an estimated signal, rs(n−1) is a reconstructed signal, namely, a signal that has been inputted again after encoded beforehand and decoded by the decoder 104. rd(n−1) is a reconstructed differential, i.e., the differential computed by the differential computation block and w(i) is a weight.

The weight is adjusted so that past samples close to a current sample have much influence on the estimated signal.

After the estimated value e(n) is computed in this manner, a difference between the estimated value and the actual value is computed and quantized using a quantization table.

That is, the quantization is such that in case there exist values 1, 2, 3, 4, 5, 6, 7, 8, 9, 10 for example, 1, 2, 3 are assigned to "a"; 4, 5, 6, 7 are assigned to "b"; and 8, 9, 10 are assigned to "c". The quantization table is QT.

The quantization is performed by the following equations.

$$d(n)=s(n)-e(n)$$

$$\text{code}(n)=k,\ QT(k-1)<d(n)<QT(k)$$

where, s(n) is an actual value, d(n) is a differential, code(n) is code value for n-th sample, namely, an encoded value, and QT(k) is a k-th quantization critical value.

Audio signals encoded through the above process are inputted to the decoder as described above and the encoded audio signals are decoded. The decoding means estimating a current sample value from a predetermined number of past samples, computing a differential that corresponds to a code value for a current sample, and adding the estimated value to the differential.

The decoding is given by the following equations.

$$rd(n)=rec(\text{code}(n))$$

$$rs(n)=e(n)+rd(n)$$

where, rec(k), i.e., rec(code(n)) becomes rd(n) which is a reconstructed value of a code k for a differential computed by the differential computation block.

Further, since rs(n) means a decoded signal, resultantly the decoded value rs(n) is obtained by computing a differential rd(n) which corresponds to a code value k for a current sample, namely, a reconstructed value of the code k for a differential computed by the differential computation block 106 and adding the estimated value e(n) to the differential.

In the meantime, a method for optimizing coding parameters will be described below.

The quantization critical value QT(k) used for the encoding and the decoding and the reconstructed value rec(k) of the code k for the differential, namely, rd(n) are important coding parameters that determines quality. Optimizing these parameters means optimizing quality under a given data rate.

In the process of optimizing these coding parameters, the encoding is performed using initial quantization critical value QT(k) and the reconstructed value rec(k) of the code k first.

Second, the above-described decoding is performed using the encoded results, so that reconstructed differential rd(n) for all of the samples is detected.

Third, clustering is performed by k-means method using the detected differential rd(n).

Fourth, a center of the clustering is assigned to the reconstructed differential value rec(k) of the code k, a determination boundary is assigned to the quantization critical value QT(k).

Figure 2:
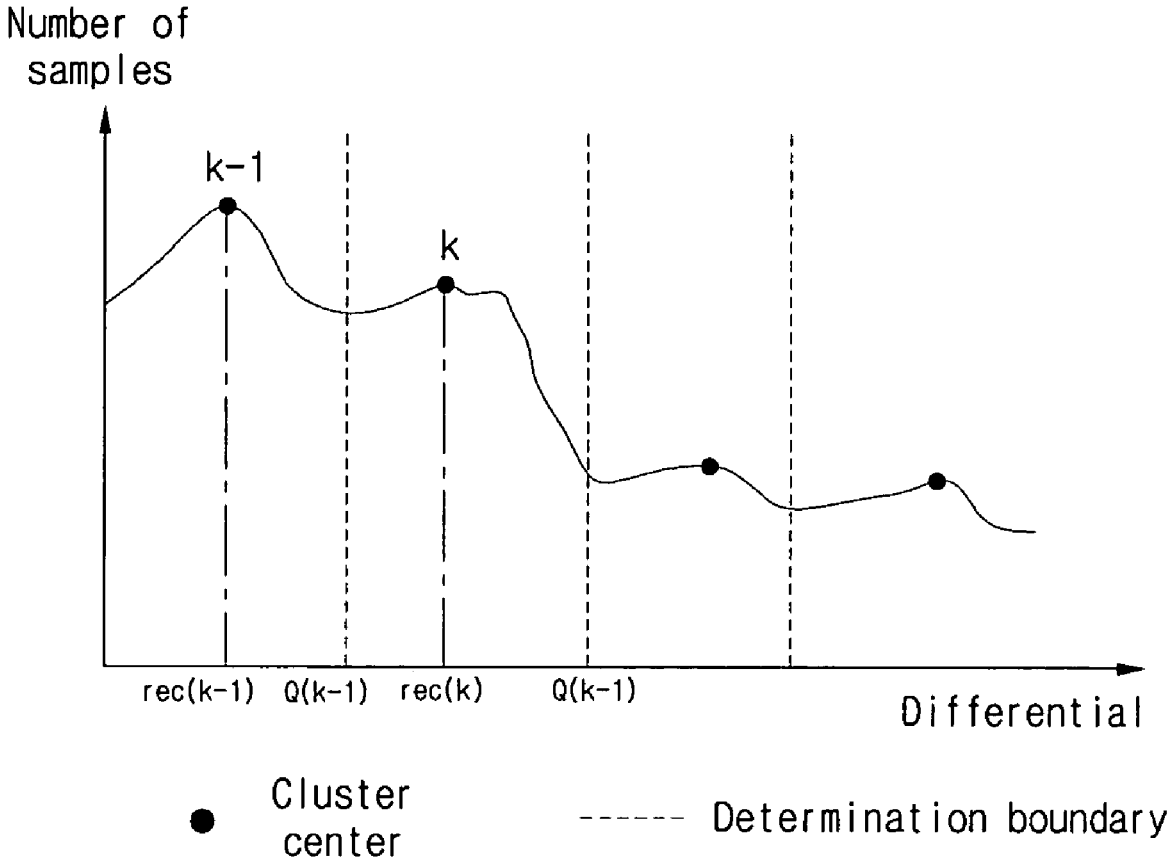
FIG. 2 is a graph illustrating a process for optimizing coding parameters according to an embodiment of the present invention.

The above description can be illustrated in FIG. 2. Referring to FIG. 2, with a horizontal axis set for differential and a vertical axis set for the number of samples (frequency), if the center of the cluster is assigned to the reconstructed differential value rec(k) of the code k, a determination boundary is assigned to the quantization critical value QT(k).

Fifth, optimized coding parameters are computed by repeatedly performing the above second through the fourth processes. The encoding is finally performed using the optimized coding parameters computed in this manner.

That is, the coding parameters are QT(1), QT(2), . . . QT(k−1), QT(k), . . . , and constantly updated during the encoding process. The process for computing the determination boundary critical value QT(k) through the process for optimizing the coding parameters is the process for computing new coding parameters.

In other words, if rd(n) is computed through the process for optimizing the coding parameters and a clustering is performed using the k-means method, a "cluster center" and a "determination boundary" are changed so that the "cluster center" is assigned to the reconstructed differential value rec(k) and the "determination boundary" is assigned to the critical value QT.

Further, if the k-means method is used, rec(k) and QT are constantly changed during the encoding/decoding processes. The optimized state is a state such that rec(k) and QT remain constant even if the encoding/decoding are repeatedly performed. rec(k) and QT at this point are optimized coding parameters.

Resultantly, the present invention reduces a storage space when storing and transmitting the audio signals and improving transmission efficiency by optimizing the coding parameters to perform the encoding of the audio signals.

Figure 3:
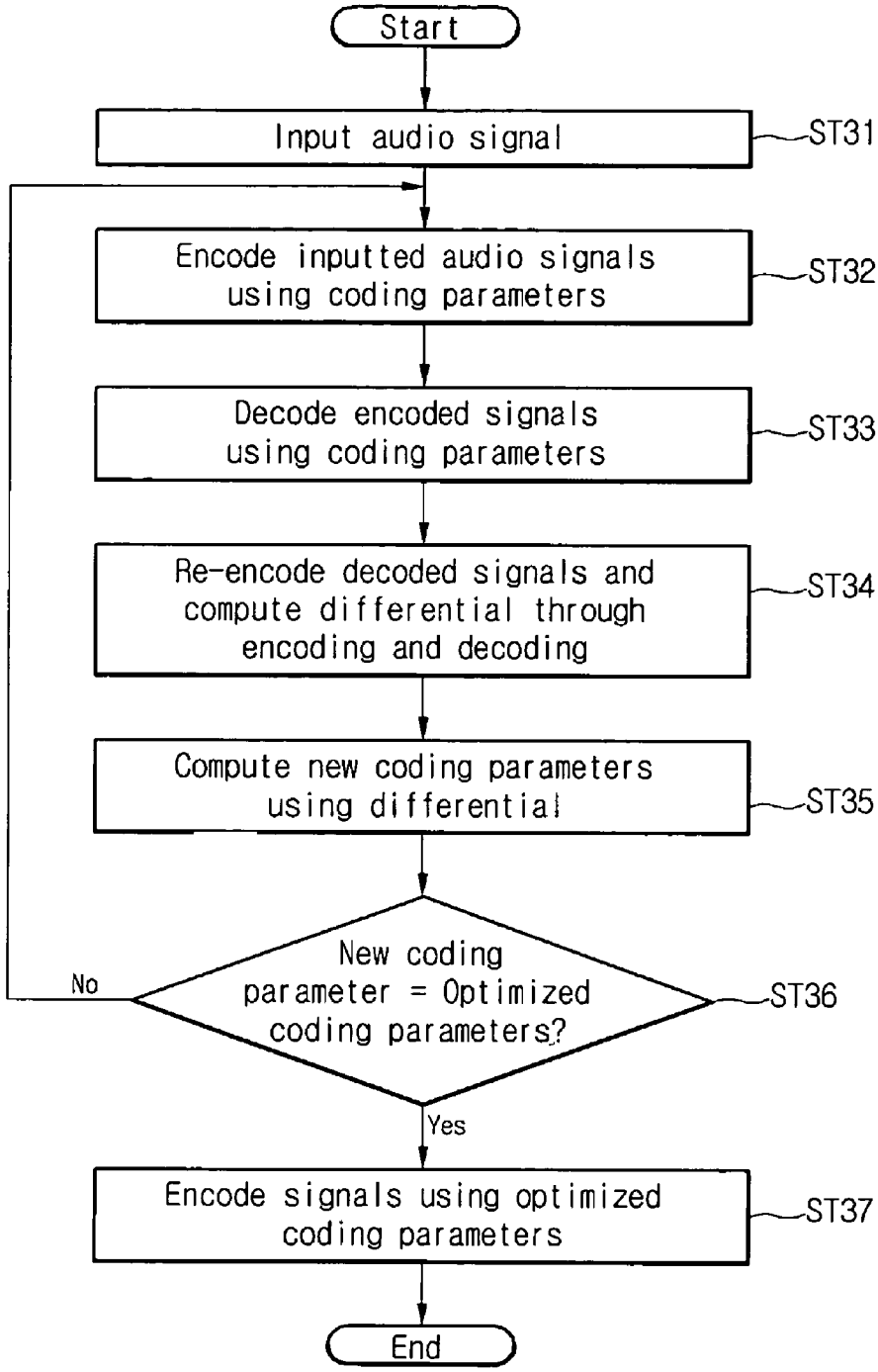
FIG. 3 is a flowchart of a method for encoding audio signals according to an embodiment of the present invention.

FIG. 3 is a flowchart of a method for encoding audio signals according to an embodiment of the present invention.

Referring to FIGS. 1 and 3, the analog audio signals are inputted to the encoder 102 within the audio codec 100 (ST 30).

The encoder 102 encodes the analog audio signals using the initial coding parameters (ST31).

The encoded audio signals are decoded by the decoder 104 using the initial coding parameters (ST32).

Further, the signals decoded by the decoder 104 are inputted to the encoder 102 so that the encoder 102 re-encodes the decoded signals inputted above. The differential is detected through the encoding and the decoding processes (ST33).

Here, the differential means a difference between an estimated value and an actual value of an audio signal in estimating a sample value of a current audio signal from a sample of a predetermined number of past audio signals.

After that, a process for computing new parameters using the computed differential and processes for encoding the decoded signals and decoding the encoded signals using the computed parameters are repeatedly performed (ST34 and 35).

Here, the encoding process means estimating a current sample value from a predetermined number of past samples with respect to the audio signals and quantizing a difference between the estimated value and the actual value.

At this point, the process of estimating a current sample value from the past samples uses a sum of reconstructed signals of the past samples and weights of reconstructed differentials of the past samples. The process of quantizing the difference between the estimated value and the actual value uses the coding parameters previously computed.

The decoding means estimating a current sample value from a predetermined number of past reconstructed samples, computing a differential that corresponds to a code value for a current sample, and adding the estimated value to the differential.

Further, the quantization critical value and the reconstructed value of the code for the differential which are used in the encoding/decoding processes are optimized during the process for computing the new coding parameters.

At this point, a sample grouping technique of the k-means method is applied to the reconstructed differential computed during the encoding process in optimizing the quantization critical value and the reconstructed value of the code for the differential. A cluster center and a determination boundary computed in the technique are assigned to the reconstructed value of the code for the differential and the quantization critical value, respectively.

That is, if the differential rd(n) is computed through the process for optimizing the coding parameters and a clustering is performed using the k-means method, a "cluster center" and a "determination boundary" are changed so that the "cluster center" is assigned to the reconstructed differential value rec(k) and the "determination boundary" is assigned to the critical value QT.

Further, if the k-means method is used, rec(k) and QT are constantly changed during the encoding/decoding processes. The optimized state is a state such that rec(k) and QT remain constant even if the encoding/decoding are repeatedly performed. rec(k) and QT at this point are optimized coding parameters.

If the optimized coding parameters are computed though the above-described processes, the audio signals are encoded using the optimized coding parameters (ST35, 36).

That is, the encoding method by the codec system 100 of the present invention encodes/decodes the analog audio signals being inputted using the initial coding parameters, repeatedly encodes/decodes the signals using the new coding parameters afterwards, thereby optimizing and computing the coding parameters and finally encoding the analog audio signals using the optimized coding parameters.

As described above, according to the codec system and the encoding method using the same of the present invention, the encoding/decoding processes are repeatedly performed to increase encoding efficiency and the coding parameters are optimized so that quality may be optimized in encoding the analog audio signals beforehand for later use, not encoding the audio signals in real time. Thus, the storage space can be reduced and the transmission efficiency can be improved when the audio signals are stored and transmitted.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An audio codec system, comprising:

an encoder for encoding analog audio signals being input using predetermined coding parameters;

a decoder for decoding the encoded audio signals using the predetermined coding parameters and outputting the decoded audio signals to the encoder;

a differential computation block for computing a differential that corresponds to a difference between an actually input signal and a signal estimated through the encoding and decoding; and a coding parameter computation block for computing new coding parameters using the computed differential, wherein the computed new coding parameters are optimized when a reconstructed value and a quantization critical value related to the computed differential become constant after changing values during repeated performance of the encoding and decoding such that the reconstructed value is assigned a same cluster center value and the quantization critical value is assigned a same determination boundary value.

2. The system according to claim 1, wherein the computed differential is a difference between an estimated value and an actual value of a current audio signal, wherein the estimated value is based on a predetermined number of past audio signals.

3. The system according to claim 1, wherein the coding parameter computation block computes new coding parameters through quantization of the differential.

4. The system according to claim 3, wherein the computed new coding parameters are optimized by repeating the encoding and decoding using the computed differential.

5. A method for encoding audio signals, the method comprising:

encoding input analog audio signals using initial coding parameters;

decoding the encoded audio signals using the initial coding parameters and re-encoding the decoded signals;

computing a differential by the encoding and decoding;

computing new coding parameters using the computed differential;

repeating the encoding and the decoding using the newly computed coding parameters each time;

optimizing the newly computed coding parameters when a reconstructed value and a quantization critical value related to the computed differential become constant after changing values during repeated performance of the encoding and the decoding such that the reconstructed value is assigned a same cluster center value and the quantization critical value is assigned a same determination boundary value; and encoding the signals using the optimized coding parameters.

6. The method according to claim 5, wherein the encoding comprises:

estimating a current sample value from a predetermined number of past samples for the input audio signals; and quantizing a difference between the estimated current sample value and an actual value of the input audio signals.

7. The method according to claim 6, wherein estimating the current sample value comprises using a sum of reconstructed signal of the past samples and weights of reconstructed differentials of the past samples, and quantizing the difference between the estimated current sample value and the actual value comprises the newly coding parameters.

8. The method according to claim 5, wherein the decoding comprises:

estimating a current sample value form a predetermined number of past reconstructed samples of the input audio signals;

computing a differential that corresponds to a code value for the current sample value; and adding the estimated current sample value to the differential.

9. The method according to claim 5, wherein computing the new coding parameters comprises optimizing the quantization critical value and the reconstructed value the computed differential.

10. The method according to claim 9, wherein optimizing the quantization critical value and the reconstructed value of the computed differential comprises applying a sample grouping technique of a k-means method to a reconstructed differential computed in the technique to the reconstructed value of the computed differential and assigning a determination boundary computed in the technique to the quantization critical value.

11. A method for encoding input audio signals, the method comprising:

repeatedly performing an encoding and a decoding in order to determine optimized coding parameters, wherein repeating the encoding and decoding comprises:

encoding the input audio signals using initial coding parameters;

decoding the encoded audio signals using the initial coding parameters; and computing new coding parameters using differential computed during the encoding; and optimizing the newly computed coding parameters when a reconstructed value and a quantization critical value related to computed differential become constant after changing values during repeated performance of the encoding and decoding such that the reconstructed value is assigned a same cluster center value and the quantization critical value is assigned a same determination boundary value.

12. The method according to claim 11, wherein the input audio signals are not encoded in real time but encoded beforehand for later use.

13. The method according to claim 12, wherein the decoding is performed in real-time.

14. The method according to claim 12, wherein the encoding comprises:

estimating a current sample value from a predetermined number of past samples for the input audio signals; and quantizing a difference between the estimated current sample value and an actual value of the input audio signals.

15. The method according to claim 14, wherein estimating the current sample value from the past samples comprises using a sum of reconstructed signals of the past samples and weights of reconstructed differentials of the past samples, and quantizing the difference between the estimated current sample value and the actual value comprises using the previously computed new coding parameters.

16. The method according to claim 11, wherein the decoding comprises:

estimating a current sample value from a predetermined number of past reconstructed samples of the input audio signals;

computing a differential that corresponds to a code value for the current sample value; and adding the estimated current sample value to the differential.

17. The method according to claim 11, wherein computing the new coding parameters comprises optimizing the quantization critical value and the reconstructed value of the computed differential.

18. The method according to claim 17, wherein optimizing the quantization critical value and the reconstructed value computed differential comprises applying a sample grouping technique of k-means method to a reconstructed differential computed during the encoding and assigning a cluster center computed in the technique to the reconstructed value of the computed differential and assigning a determination boundary computed in the technique to the quantization critical value.

19. The method according to claim 16, wherein estimating the current sample value is performed according to the following equation:

$$e(n) = rs(n-1) + \sum_{i=1}^{M} w(i) * \mathrm{rd}(n-i)$$

where e(n) is an estimated signal, rs(n−1) is a reconstructed signal, rd(n−i) is a reconstructed differential, and w(i) is a weight, wherein the reconstructed signal is a signal that has been input again after being pre-encoded and decoded.

* * * * *